US005080160A

United States Patent [19]

Gephart et al.

[11] Patent Number: 5,080,160

[45] Date of Patent: Jan. 14, 1992

[54] TRACK AND PIVOT BRACKET FOR BI-FOLD DOORS

[75] Inventors: John D. Gephart, LaVerne; Robert Brydolf, Pasadena, both of Calif.

[73] Assignee: The Stanley Works, New Britain, Conn.

[21] Appl. No.: 493,491

[22] Filed: Mar. 14, 1990

[51] Int. Cl.[5] ..... E05D 15/26

[52] U.S. Cl. ..... 160/206; 160/199; 16/94 R

[58] Field of Search ..... 160/117, 118, 119, 206, 160/199, 210, 213; 16/94 R, 95 R

[56] References Cited

U.S. PATENT DOCUMENTS 3,096,539 7/1963 Dickinson et al. ..... 160/206 X
3,178,800 6/1965 Kirby ..... 160/206
3,221,804 12/1965 Rudnick ..... 160/206
3,246,684 4/1966 Rudnick ..... 160/206 X
3,285,324 11/1966 Stein et al. ..... 160/206
3,583,464 6/1971 Johnson, Jr. ..... 160/206

OTHER PUBLICATIONS

Stanley Acme "FasTrack TM Closet Door Hardware" 1989 catalog, pp. 2-8, 23-29 and 30.

*Primary Examiner*—Blair M. Johnson
*Attorney, Agent, or Firm*—Christie, Parker & Hale

[57] ABSTRACT

A track assembly for a bi-fold door comprises a guide track having an elongated flat base, a pair of sides, and a pivot bracket. The outer edge of each side of the track is inwardly directed toward the base and defines a channel therein. A pair of runners extending from the pivot bracket provides means for reinforcing a portion of the guide track and reduces track vulnerability to deformation caused by lateral forces.

6 Claims, 4 Drawing Sheets

Fig. 1
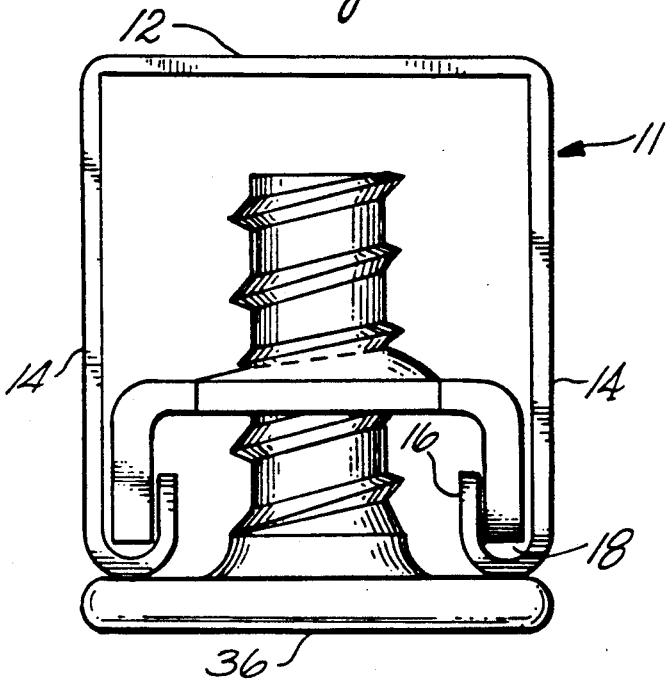
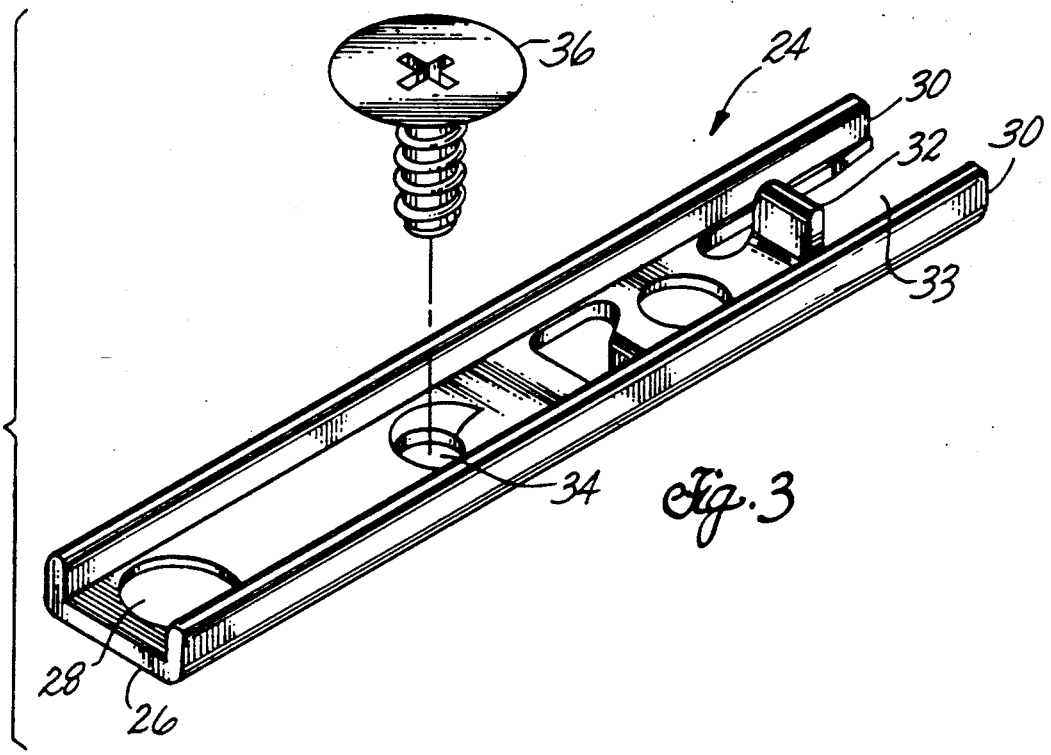
Fig. 3

11
20
20
14
14
18
16
18
22
22
22

11
30
24
30
18
36
38
32
40
42
44

TRACK AND PIVOT BRACKET FOR BI-FOLD DOORS

FIELD OF THE INVENTION

The present invention relates to guide tracks and related hardware for bi-fold doors.

BACKGROUND OF THE INVENTION

A type of door that has become increasingly popular, particularly for closets and the like, is a so-called bi-fold door. In a typical opening, four door panels are used. Two of these panels are hinged together at each side of the opening. In a smaller opening, only two door panels are used. The panel nearer the jamb, known as the pivot door, may be pivoted at the top and bottom to support the full weight of both doors. The other panel further from the side of the opening, known as the lead door, typically has guides at the top which run in tracks to keep the edge of the door within the frame.

Thus, when the doors are closed, both doors are in the plane of the frame. To open a pair of doors one pulls at the hinge line, causing the doors to "fold" relative to each other. As the doors open, the pivot door pivots adjacent the jamb and the hinged edge of the lead door swings outwardly as constrained by the hinges between the doors and the guides in the tracks.

The guide tracks used with bi-fold doors are typically elongated U-shaped channels having an elongated projection or ledge extending inwardly from each side of the track. A pivot bracket is seated on or against the pair of ledges and is securely fastened to the track with a screw or similar fastener. Typically, the pivot bracket, which can be relocated in the track, comprises two or more parts which straddle the inwardly directed ledges from above and below and which are held together by the fastener. The pivot bracket provides means for holding a pivot in the pivot door in position within the track.

The pivot bracket commonly provides another function. It has some length along the inside of the track so that when the doors are fully open, there is some "lead" left between the doors. That is, the edges of the fully open doors are spaced apart somewhat in the track by reason of the guide on the lead door striking the end of the pivot bracket. Lead is provided between the doors so that one can close the doors by merely pushing at the hinge line. The lead provides a small angle which lets the lead door commence to move, whereas if edges of the doors were in contact, the doors would be perpendicular to the frame and wouldn't move merely by pushing toward the frame at the hinge line.

When bi-fold doors are slammed open, as commonly happens in service, lateral forces act on the guide tracks and can result in track deformation. The lateral force occurs as the moving doors are stopped. There is an inertial effect tending to make them keep moving. This inertial effect creates a moment causing a lateral force on the track at the location where the lead door guide encounters the end of the pivot bracket. If there is sufficient deformation the pivot bracket can be disengaged from the supporting ledges and popped out of the track, resulting in door failure.

This problem has heretofore been addressed by using stronger tracks, i.e., by making the sides of the tracks thicker, and/or by making the tracks out of stronger materials. Both approaches increase the cost of the tracks.

Accordingly, a need exists for a bi-fold door track assembly that reduces track vulnerability to deformation, yet is inexpensive to manufacture. Such an assembly should be easy to use and install and should be compatible with a variety of bi-fold door designs.

SUMMARY OF THE INVENTION

The present invention provides a guide track and pivot bracket, collectively referred to as a track assembly for a bi-fold door. The guide track comprises an elongated flat base and a pair of sides, the outer edge of each side being curved inwardly toward the base and defining a channel therein. In an exemplary embodiment the pivot bracket comprises an elongated body having a pivot hole at one end, and a pair of runners on opposite edges of the body and extending a short distance past the end of the body remote from the pivot hole. The runners are inserted into the channels in the guide track, and the pivot bracket is secured to the track by a fastener inserted through a threaded hole in the pivot bracket.

The extended ends of the runners serve to reinforce the guide track near the pivot bracket and reduce the track's vulnerability to deformation caused by a bi-fold door attached to the track assembly being slammed open. The unique pivot bracket and track design enables the track to be constructed of thinner material than is normally used in bi-fold door guide tracks.

BRIEF DESCRIPTION OF THE DRAWINGS

FIG. 1 is an end view of a track and pivot bracket constructed according to the present invention;

FIG. 3 is a perspective view of a pivot bracket;

DETAILED DESCRIPTION

Figure 2:
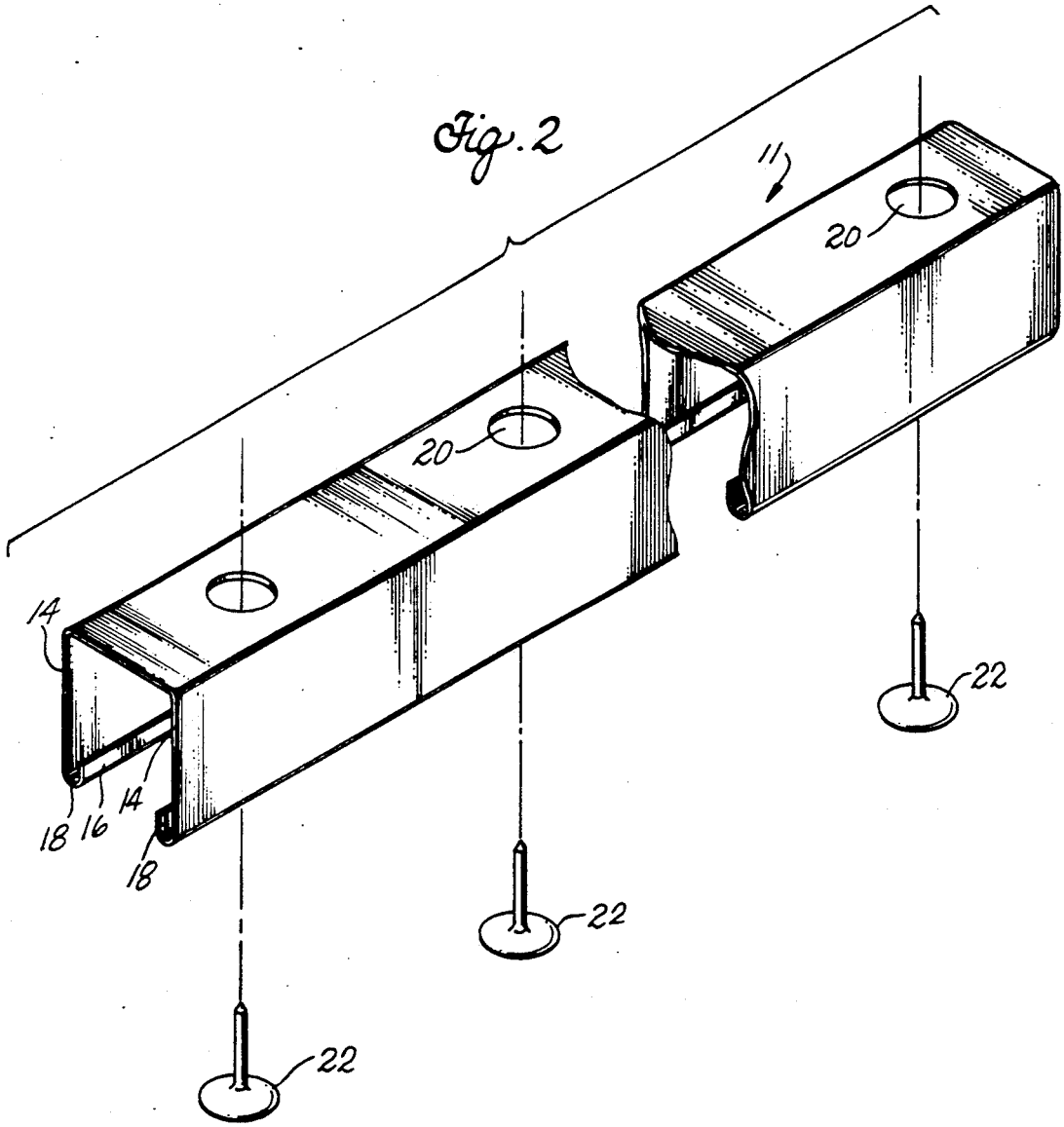
FIG. 2 is an exploded view of a guide track and fasteners.

A guide track 11 for bi-fold doors has a generally U-shaped transverse cross section comprising an elongated base 12 and a pair of sides 14 extending from the base. In a exemplary embodiment the sides are generally parallel. Preferably, the sides are integral with the base.

The outer edge 16 of each side is curved or inwardly directed toward the base of the track. Thus, an elongated channel 18 is defined between each side and its curved outer edge.

A plurality of holes 20 extend through the track's base. The holes are spaced apart from each other, preferably in increments of equal distance Together with a plurality of fasteners 22, such as nails, screws, bolts, etc., the holes provide means for fastening the track to a surface such as a door lintel, ceiling, etc.

A pivot bracket 24 is fastened to the track, preferably at or near an end of the track. The bracket has a shallow U-shaped transverse cross section and comprises a generally rectangular body having a base 26 with a hole 28 formed therein for receiving a pivot and a pair of runners 30 on opposite edges of the base. The runners are inserted into the channels 18 in the guide track. The runners are longer than the base and extend past the end of the body remote from the pivot hole 28. As described below, the extended ends of runners provide means for reinforcing a portion of the guide track.

A flange or stop 32 projects from the end of the base between the extended runners. The flange provides means for stopping a guide on a lead door, as described below. A U-shaped slot 33 is defined by the flange and the extended end of the runners. A threaded hole 34 is formed in the body between the pivot hole and the extended end of the runners. Together with a threaded fastener 36, the threaded hole provides means for fastening the pivot bracket to the guide track.

The present invention can be manufactured from a variety of materials and can be produced in a variety of sizes and dimensions in accordance with the length of the opening in which the track is to be installed and the size and weight of the bi-fold door panels used. In an exemplary embodiment, the guide track is formed of prepainted commercial quality cold rolled steel having a thickness of from 0.019+0.006-0.000 inch (0.048+0.015-0.000 cm). In contrast, the thickness of prior art guide tracks is a minimum of 0.026 inch (0.066 cm).

The base 12 of the track is about 0.7 inch (1.78 cm) across and the sides 14 are about 0.7 inch (1.78 cm) high. The channels 18 are about 0.1 inch (0.25 cm) across. Preferably, the surface of the inwardly curved outer edge 16 of each side is coated with silicone fluid, which serves to lubricate a lead door guide as it slides within the track.

The pivot bracket 24 is preferably made of commercial quality cold rolled steel having a thickness of from 0.055 to about 0.063 inch (0.140 to 0.160 cm). The body 26 is about three inches (7.62 cm) long and about 0.5 to 0.6 inch (1.27 to 1.52 cm) wide. The pivot hole 28 has a diameter of about 0.4 inch (1.02 cm). Each runner 30 is 0.14 inch (0.36 cm) high and extends past one end of the body for 0.4 to 0.5 inch (1.02 to 1.27 cm). An additional guide hole and flange may be formed in the plate for production purposes.

Figure 4:
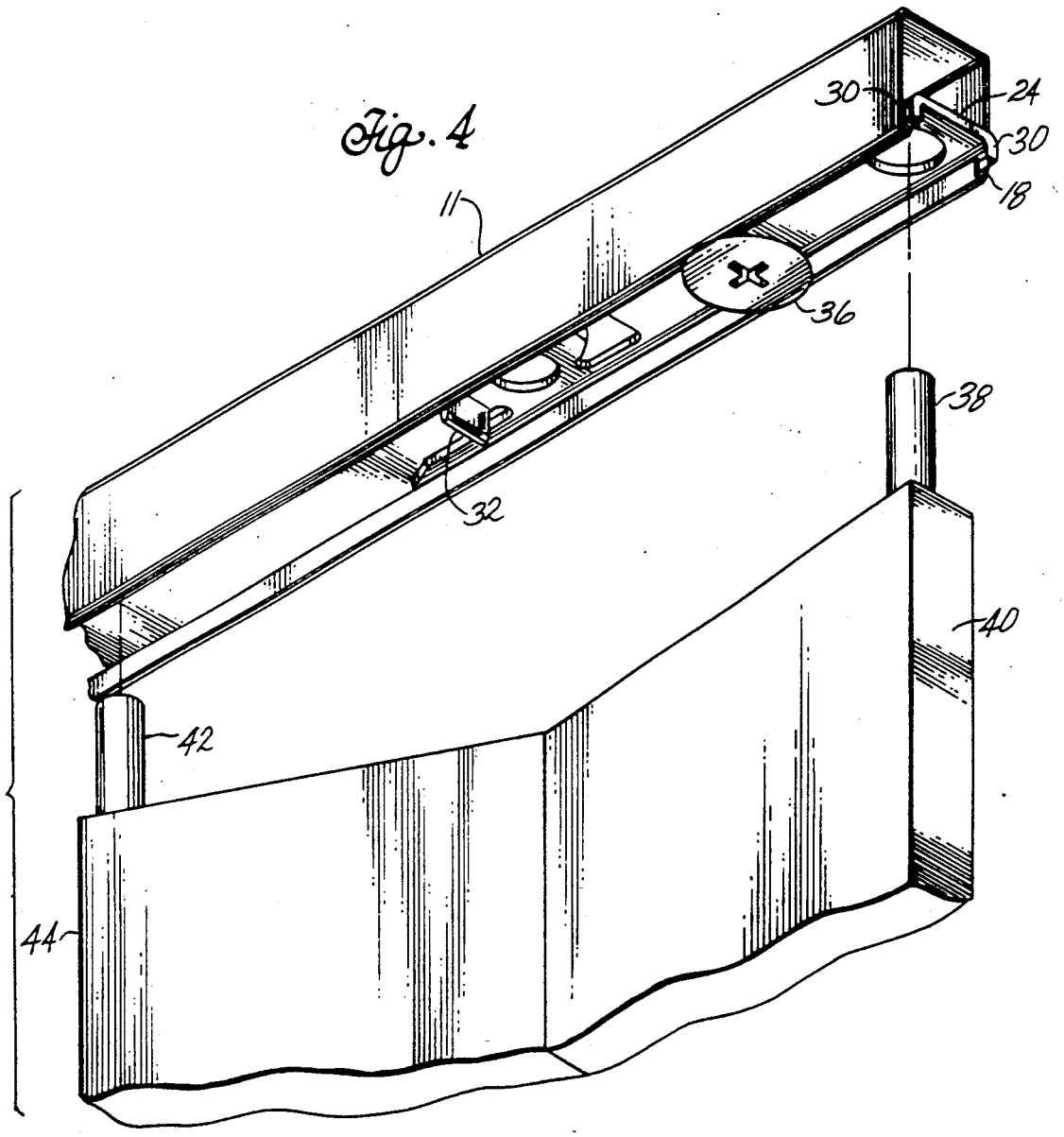
FIG. 4 is a schematic, partially exploded view of a bi-fold door and track assembly.

The beneficial nature of a track assembly comprising the above-described track and pivot bracket is realized when such an assembly is installed and used with a bi-fold door. FIG. 4 depicts a schematic, partially exploded view of a bi-fold door attached to an upper track assembly. In practice, the bi-fold door is also secured to a lower track assembly in the bottom of the door opening.

The guide track 11 is secured to the lintel of the opening and a pivot bracket 24 is fastened in one end of the track. The runners 30 on the bracket are inserted into the channels 18 in the track and the threaded fastener 36 is tightened against the track. The pivot bracket is oriented such that the pivot hole 28 is near the end of the track and the flange 32 faces the track's middle. The position of the pivot bracket along the track is adjusted to accommodate the location of a pivot 38 relative to the edge of the pivot door 40 nearest the jamb. The pivot is seated in the pivot hole 28 in the pivot bracket and is free to rotate therein.

A guide 42 extending from the lead door 44 is seated in the track and can ride freely therein. The pivot door and lead door are, of course, hinged together.

When the bi-fold door is closed, the pivot door, lead door, and guide track all lie in the same plane. By pulling on a handle (not shown), or by pushing on the pivot door, the pivot door rotates about the pivot 38 and the bi-fold door opens as the guide 42 extending from the lead door 44 slides in the track toward the pivot bracket.

If the bi-fold door is opened all the way, the guide 42 eventually abuts the stop (flange) 32 projecting from the pivot bracket 24. Slamming the door open causes the guide to strike the stop with considerable force. If the pivot bracket is fastened to the guide track tightly enough, the impact of the guide hitting the stop does not cause the bracket to move. However, because the pivot door and lead door are joined at a hinge joint, a lateral force is exerted on the lead door and, accordingly, the guide track.

Figure 5:
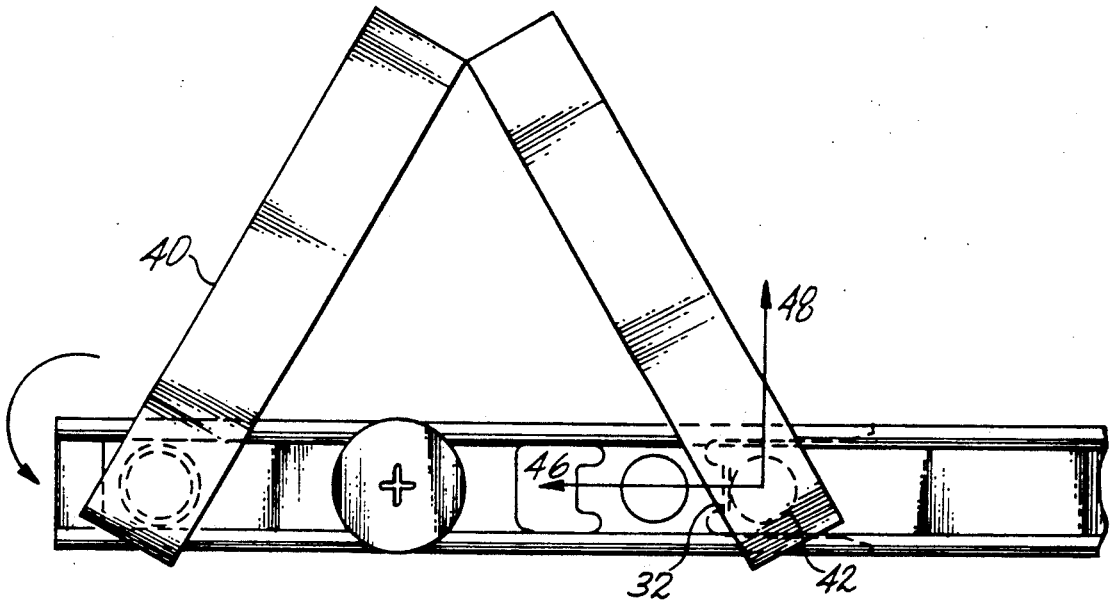
FIG. 5 is a schematic force diagram.

As illustrated in FIG. 5, as the pivot door 40 rotates about the pivot, both a longitudinally directed force 46 and a laterally directed force 48 are exerted on the guide 42 and, accordingly, the guide track 11. If the bi-fold door is slammed open hard enough, or a sufficient number of times, the guide track can be deformed or dented. The propensity for track deformation, however, is greatly reduced in practice of the present invention because of the reinforcement provided by the pivot bracket runners extending beyond the stop.

More particularly, a laterally directed force incident upon one side of the guide track is transferred to the extended end of the runner 30 positioned in the channel 18 between the side of the track and its outer edge. The runners absorb some of the force and provide reinforcement to the sides of the guide track.

Impact tests performed on a guide track assembly made in accordance with the present invention indicate that the present invention provides a significant decrease in track vulnerability to deformation. In an impact test, a heavy weight is connected to the lead door panel of a bi-fold door via a cable strung over a pulley. The weight is allowed to drop, causing the door to quickly open and the guide on the lead door to strike the pivot bracket. The weight comes to rest just before the guide strikes the pivot bracket; therefore, all impact on the bracket (and track) is due to the door's inertia. Repetition of the test leads to an indication of the track's tendency to deform under use conditions.

Although but limited embodiments of a track assembly have been described and illustrated herein, many modifications and variations will be apparent to one skilled in the art. For example, instead of runners insertable into channels in the guide track, the pivot bracket can have shallow sides which straddle the exterior of the outer edges of the guide track's sides. The shallow sides extend a short distance from the end of the bracket remote from the pivot hole, and an U-shaped slot is defined by the extended ends of the sides and a flange similar to the one described above extending from the body of the bracket. Track reinforcement occurs where the extended ends of the pivot bracket's sides define the U-shaped slot. It is, therefore, to be understood that this invention may be practiced otherwise than as specifically described and is limited in scope only by the appended claims.

What is claimed is:

1. A track assembly comprising:

an elongated track having a generally U-shaped transverse cross section; and a pivot bracket mounted in the track, the pivot bracket comprising a pivot hole at one end, a door stop at the other end, and means extending away from the one end and beyond the door stop on each side of the door stop for contacting and reinforcing the track.

2. A track assembly as recited in claim 1 wherein the reinforcing means comprise a pair of runners positioned on opposite edges of the bracket, the track having channels formed at the ends of the U-shaped cross section, the runners being disposed in and contacting the channels.

3. A track assembly as recited in claim 1 where the door stop comprises a flange projecting from the pivot bracket.

4. A bi-fold door set comprising:

a pivot door;

a lead door hinged to the pivot door;

a track having a generally U-shaped cross section mounted in a door frame;

a pivot bracket mounted in the track;

a pivot connecting an edge of the pivot door to the pivot bracket proximate one end of the pivot bracket;

a guide at an edge of the lead door for riding in the track;

a stop on the pivot bracket at the end remote from the one end for stopping the guide of the lead door and thereby stopping the lead door; and means on the pivot bracket for reinforcing the track adjacent the end of the pivot bracket remote from the pivot, wherein the reinforcing means extends beyond the stop in a direction away from the pivot to distribute force along the track, to thereby reinforce the track during stopping of the lead door.

5. A bi-fold door set as recited in claim 4, where the reinforcing means comprise a pair of runners integral with opposite edges of the pivot bracket and having ends extending past the end of the pivot bracket remote from the pivot.

6. A bi-fold door set as recited in claim 5 where the track has opposing channels formed at ends of the U-shaped cross section, and the runners are seated in the channels.

* * * * *